US008002248B2

(12) United States Patent
Hu et al.

(10) Patent No.: US 8,002,248 B2
(45) Date of Patent: Aug. 23, 2011

(54) DIFFUSER FOR AN AERATION SYSTEM

(75) Inventors: Yen-Jung Hu, Tainan Hsien (TW); Huang-Chin Pan, Tainan Hsien (TW)

(73) Assignee: Kang NA Hsiung Enterprise Co., Ltd. (TW)

( * ) Notice: Subject to any disclaimer, the term of this patent is extended or adjusted under 35 U.S.C. 154(b) by 0 days.

(21) Appl. No.: 12/699,346

(22) Filed: Feb. 3, 2010

(65) Prior Publication Data

US 2010/0133709 A1 Jun. 3, 2010

Related U.S. Application Data

(63) Continuation-in-part of application No. 12/141,994, filed on Jun. 19, 2008, now Pat. No. 7,681,867.

(30) Foreign Application Priority Data

Nov. 6, 2009 (TW) ..... 98137739 A

(51) Int. Cl.
*B01F 3/04* (2006.01)

(52) U.S. Cl. ..... 261/62; 261/122.1; 261/122.2

(58) Field of Classification Search ..... 261/62, 261/122.1, 122.2, 124; 210/150, 151, 220, 210/221.1, 221.2
See application file for complete search history.

(56) References Cited

U.S. PATENT DOCUMENTS

| | | | | | |
|---|---|---|---|---|---|
| 1,759,983 | A * | 5/1930 | Houston | 261/122.2 |
| 3,997,634 | A * | 12/1976 | Downs | 261/122.2 |
| 4,629,126 | A * | 12/1986 | Goudy et al. | 239/452 |
| 4,842,779 | A * | 6/1989 | Jager | 261/122.2 |
| 4,848,749 | A | 7/1989 | Schneider | 261/62 |
| 4,849,139 | A * | 7/1989 | Jager | 261/122.2 |
| 5,330,688 | A | 7/1994 | Downs | 261/122.2 |
| 5,422,043 | A | 6/1995 | Burris | 261/122.1 |
| 5,693,265 | A * | 12/1997 | Jager et al. | 261/122.2 |
| 5,705,063 | A | 1/1998 | Lee | 210/220 |
| 5,858,283 | A | 1/1999 | Burris | 261/122.1 |
| 6,145,817 | A | 11/2000 | Jager et al. | 261/122.2 |
| 6,345,812 | B1 * | 2/2002 | Jager et al. | 261/122.1 |
| 6,367,783 | B1 * | 4/2002 | Raftis | 261/122.1 |
| 6,464,211 | B1 * | 10/2002 | Downs | 261/122.1 |
| 6,645,374 | B2 | 11/2003 | Cote et al. | 210/151 |
| 7,044,453 | B2 | 5/2006 | Tharp | 261/122.1 |
| 7,243,912 | B2 | 7/2007 | Petit et al. | 261/122.2 |
| 2005/0184408 | A1 | 8/2005 | Petit et al. | 261/122.1 |
| 2007/0001323 | A1 * | 1/2007 | Kang | 261/122.1 |
| 2010/0133709 | A1 * | 6/2010 | Hu et al. | 261/122.2 |

FOREIGN PATENT DOCUMENTS

| | | | |
|---|---|---|---|
| EP | 229386 | 7/1987 | 261/122.2 |

* cited by examiner

*Primary Examiner* — Richard L Chiesa

(74) *Attorney, Agent, or Firm* — Bliss McGlynn, P.C.

(57) ABSTRACT

A diffuser for an aeration system includes a base, a valve member, and a diaphragm. The diaphragm has a central portion, a peripheral portion, and a surrounding segment. The surrounding segment is interposed between the central portion and the peripheral portion, and includes a base web layer and a porous foam layer. The base web layer includes a plurality of fibrous filaments arranged to form a textured structure with a plurality of pores. The porous foam layer is disposed on the base web layer.

14 Claims, 5 Drawing Sheets

DIFFUSER FOR AN AERATION SYSTEM

CROSS-REFERENCE TO RELATED APPLICATIONS

This application is a continuation-in-part of U.S. patent application Ser. No. 12/141,994, filed on Jun. 19, 2008, now U.S. Pat. No. 7,681,867, and claims priority from Taiwanese Application No. 098137739, filed on Nov. 6, 2009.

BACKGROUND OF THE INVENTION

1. Field of the Invention

The invention relates to a diffuser for an aeration system, and more particularly to a diffuser which allows gas introduced in the aeration system to form small and fine bubbles, so as to increase the concentration of a gas, such as oxygen, that is dissolved in a water pool equipped with the aeration system.

2. Description of the Related Art

In order to establish an aerobic condition commonly used in the treatment of wastewater or sewage, or in the cultivation of biological materials in water pools, an aeration system is employed to increase the oxygen concentration in water.

An aeration system includes a plurality of diffusers adapted to be provided on the bottom of a water pool, conduits connected to the plurality of diffusers, and a blower forcing air to flow into the conduits and to pass through the slits provided in the diffusers, so as form bubbles in the water pool.

A conventional diffuser disclosed in, for example, U.S. Pat. No. 5,330,688 comprises a disk-shaped membrane diffuser made of an elastomeric material and provided with a plurality of slits, which are spaced apart from each other and arranged circularly, to allow the passage of air therethrough to form bubbles in a water pool. The elastomeric material for the conventional membrane diffuser is generally a synthetic rubber, such as ethylene-propylene-diene monomer (EPDM) rubber. In order to increase the concentration of the dissolved gas in the water, the slits of the membrane diffuser are made as small as possible and are provided at a density that is as high as possible. However, since the elastomeric material is tough, limits are encountered with respect to how small the slits can be made and to how high the density of the slits of the elastomeric membrane diffuser can be provided. The slits of the membrane diffuser of the conventional diffuser are generally millimeter-sized.

SUMMARY OF THE INVENTION

An object of the present invention is to provide a diffuser for an aeration system which is enhanced in oxygen transfer coefficient and standard oxygen transfer rate so as to increase the dissolved gas concentration in a water pool.

Accordingly, the diffuser for an aeration system of this invention includes a base, a valve member, and a diaphragm.

The base has a major wall with a periphery, and defines a central line that is normal to the major wall. The major wall has an outer major surface and an inner major surface opposite to the outer major surface, and defines an inlet that is adapted to introduce thereinto an aerating gas from the aeration system to generate a back pressure and that extends along the central line through the outer major surface to form thereon a valve seat.

The valve member is configured to engage the valve seat so as to close the inlet.

The diaphragm has a central portion, a peripheral portion, and a surrounding segment. The central portion is disposed to carry the valve member to place the diaphragm in a non-aerating position when the inlet is closed. The peripheral portion surrounds the central portion, and is secured to the periphery of the major wall to form upstream and downstream sides separated by the diaphragm such that, when the back pressure at the upstream side is higher than an ambient pressure at the downstream side, the valve member is forced to move away from the valve seat to place the diaphragm at an aerating position. The surrounding segment is interposed between the central portion and the peripheral portion, and includes a base web layer and a porous foam layer. The base web layer has a first surface facing the downstream side and a second surface opposite to the first surface, and includes a plurality of fibrous filaments arranged to form a textured structure with a plurality of pores. The porous foam layer is disposed on the second surface of the base web layer.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Referring to FIGS. 1, 2, 3, and 4, the first embodiment of a diffuser 1 for an aeration system according to this invention includes a base 2, a valve member 4, and a diaphragm 3.

Figure 1:
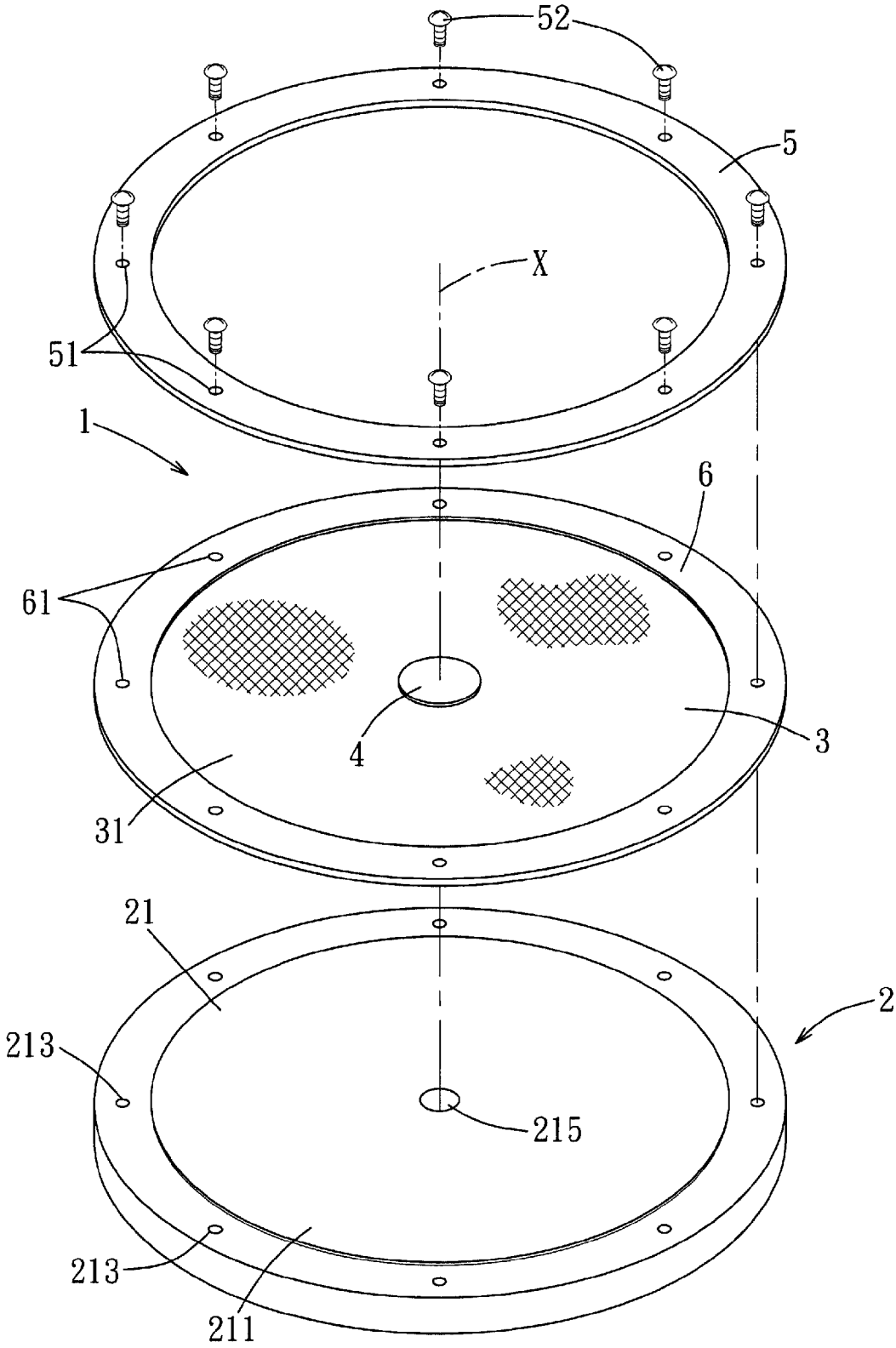
FIG. 1 is an exploded perspective view of a first preferred embodiment of a diffuser for an aeration system according to this invention.
Figure 2:
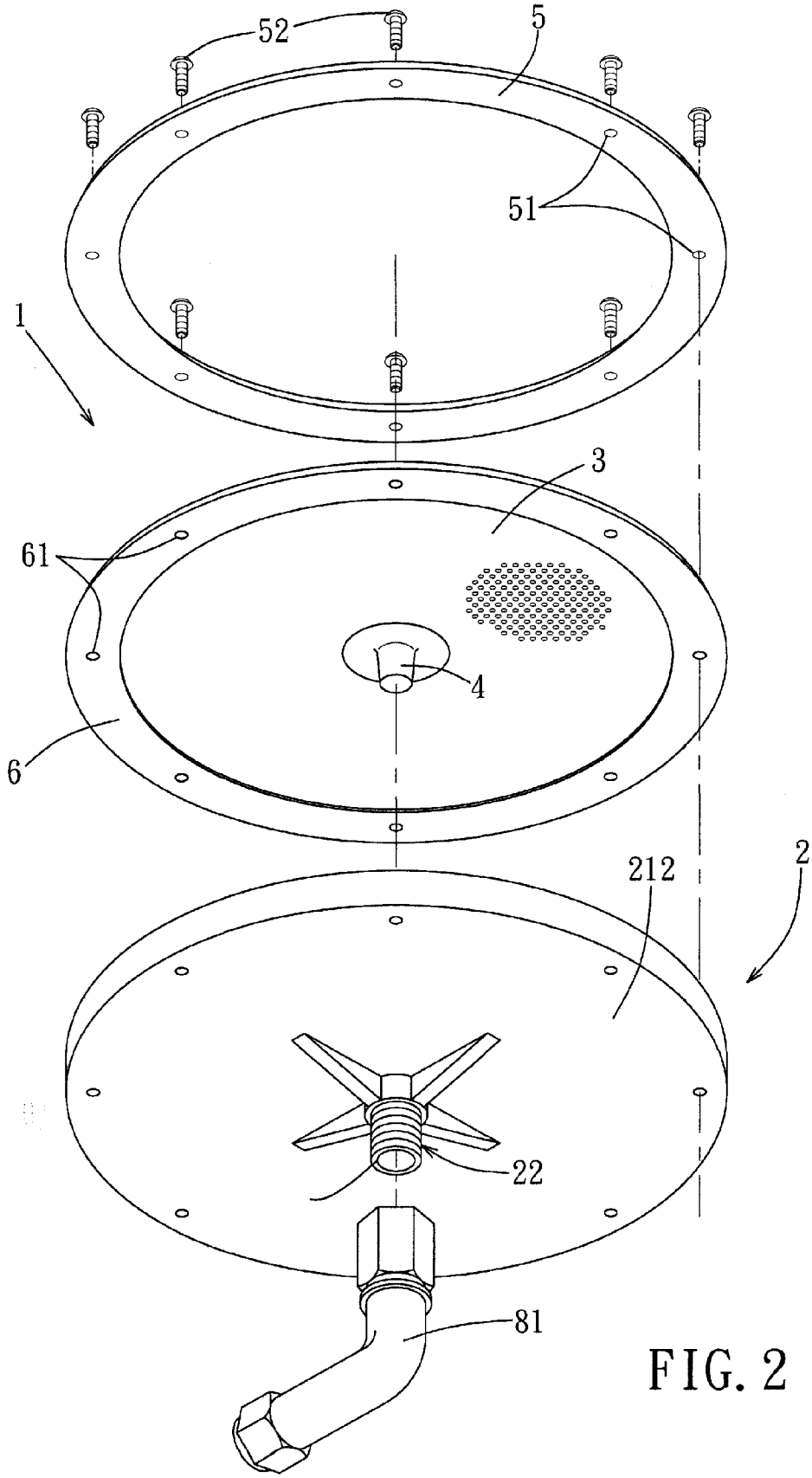
FIG. 2 is another exploded perspective view of the first preferred embodiment.

The base 2 has a major wall 21 with a periphery 214, and defines a central line (X) that is normal to the major wall 21. The major wall 21 has an outer major surface 211 and an inner major surface 212 opposite to the outer major surface 211, and defines an inlet 215 that is adapted to introduce thereinto an aerating gas from the aeration system to generate a back pressure and that extends along the central line (X) through the outer major surface 211 to form thereon a valve seat 216. The base 2 may further have a conduit portion 22 which extends from the inner major surface 212 along the central line (X) and which is in fluid communication with the inlet 215 for the introduction of an aerating gas from a conduit 81 of the aeration system into the inlet 215. In order to allow the diffuser 1 to be easily replaced, the conduit portion 22 of the base 2 is threaded so as to allow for detachable engagement of the conduit 81 of the aeration system to the base 2, as shown in FIG. 2.

The valve member 4 is configured to engage the valve seat 216 so as to close the inlet 215. Specifically, the valve member 4 comprises a head portion 41 and a stem portion 42 which extends along the central line (X) and can close the inlet 215 by engaging with the valve seat 216. The diaphragm 3 is placed between the head portion 41 and the stem portion 42 and is pressed therebetween. Preferably, the valve member 4 is made of a waterproof elastomeric material, such as polyurethane.

The diaphragm 3 has a central portion 31, a peripheral portion 32, and a surrounding segment 33. The central portion 31 is disposed to carry the valve member 4 to place the diaphragm 3 at a non-aerating position when the inlet 215 is closed. The peripheral portion 32 surrounds the central portion 31, and is secured to the periphery 214 of the major wall 21 to form upstream and downstream sides separated by the diaphragm 3 such that, when the back pressure at the upstream side is higher than an ambient pressure at the downstream side, the valve member 4 is forced to move away from the valve seat 216 to place the diaphragm 3 at an aerating position. The surrounding segment 33 is interposed between the central portion 31 and the peripheral portion 32, and includes a base web layer 331 and a porous foam layer 332. The base web layer 331 has a first surface 3311 facing the downstream side and a second surface 3312 opposite to the first surface 3311, and includes a plurality of fibrous filaments of about 150 deniers arranged to form a textured structure with a plurality of pores. Preferably, the base web layer 331 has an elongation at break of no more than 20%, and is made of a woven fabric, a non-woven fabric, a mesh structure, or combinations thereof. Preferably, the base web layer 331 has a basis density of about 180 g/m$^2$ and a thickness of about 0.17 mm.

The porous foam layer 332 is disposed on the second surface 3312 of the base web layer 331, and is made of a material which is less flexible than that of the base web layer 331. Specifically, the porous foam layer 332 is formed by applying a foamable synthetic resin composition to the second surface 3312, and subjecting the resin composition to a foaming process. Preferably, the foamable synthetic resin composition comprises a polycarbonate resin, a polyethylene resin, a polypropylene resin, a polyurethane resin, or combinations thereof. More preferably, the foamable synthetic resin composition comprises a polycarbonate resin.

The porous foam layer 332 is configured to stay in abutment with the outer major surface 211 of the major wall 21 at the non-aerating position, and is formed with a plurality of micropores of a dimension such that at the aerating position, the introduced aerating gas is permitted to be bubbled through the micropores of the porous foam layer 332, and such that the abutment of the porous foam layer 332 with the outer major surface 211 of the major wall 21 is sufficient to institute a barrier to guard against a back flow through each one of the micropores immediately after the back pressure drops below the ambient pressure. Furthermore, the pores of the base web layer 331 have such a dimension as not to interfere with the bubbling of the introduced aerating gas through the micropores of the porous foam layer 332. Specifically, the mean size of the micropores of the porous foam layer 332 is smaller than that of the pores of the base web layer 331. The mean size of the micropores of the porous foam layer 332 can be controlled by selecting the type and amount of a foaming agent, adjusting the operating parameters of a foaming machine, or the like. The mean size of the micropores of the porous foam layer 332 ranges preferably from 1 μm to 16 μm, more preferably from 3 μm to 8 μm, and most preferably from 5 μm to 7 μm. The porous foam layer 332 has a gas permeability ranging preferably from 1 to 20 cc/cm$^2$·sec, more preferably from 3 to 10 cc/cm$^2$·sec, and most preferably from 6 to 9 cc/cm$^2$·sec. The porous foam layer 332 has a thickness ranging preferably from 0.05 mm to 10 mm, and more preferably from 0.1 mm to 5 mm. Most preferably, the thickness of the porous foam layer 332 is 1 mm.

The peripheral portion 32 of the diaphragm 3 includes an annular frame 6 which is made from a stiff material such that the surrounding segment 33 is maintained in a state of tension through connection with the annular frame 6. The diffuser 1 further includes a securing ring 5 which is configured to mate with and secure the annular frame 6 to the periphery 214 of the base 2 via a plurality of screws 52, a plurality of screw holes 51 in the securing ring 5, a plurality of screw holes 61 in the annular frame 6 and a plurality of screw holes 213 in the periphery 214 of the base 2. Furthermore, the peripheral portion 32 of the diaphragm 3 can be coated with a waterproof elastomeric material, such as polyurethane, so as to enhance the air-sealing attachment amongst the securing ring 5, the annular frame 6 and the periphery 214 of the base 2.

Figure 5:
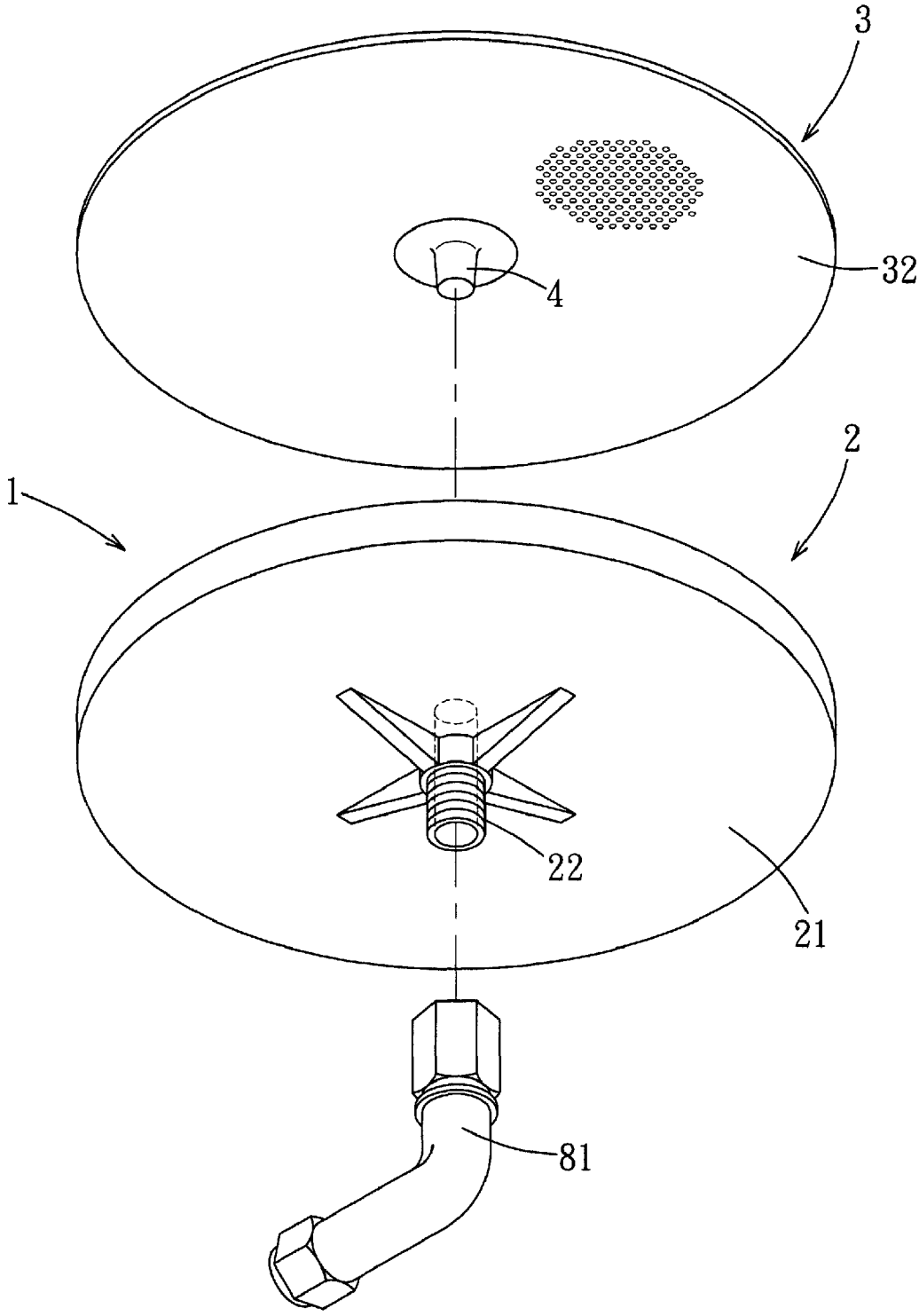
FIG. 5 is an exploded perspective view of a second preferred embodiment of a diffuser for an aeration system according to this invention.

Referring to FIG. 5, the second preferred embodiment of a diffuser for an aeration system according to this invention differs from the first preferred embodiment in that the peripheral portion 32 of the diaphragm 3 is directly connected to the major wall 21 of the base 2 supersonically.

The diffuser 1 can be connected to the conduit 81 of an aeration system (not shown), which is equipped in a bottom of a pool for the treatment of wastewater or sewage, or for the cultivation of biological materials in water pools. A blower (not shown) is connected to the conduit 81 to allow an aerating gas (such as air) to flow into the conduit 81.

Figure 3:
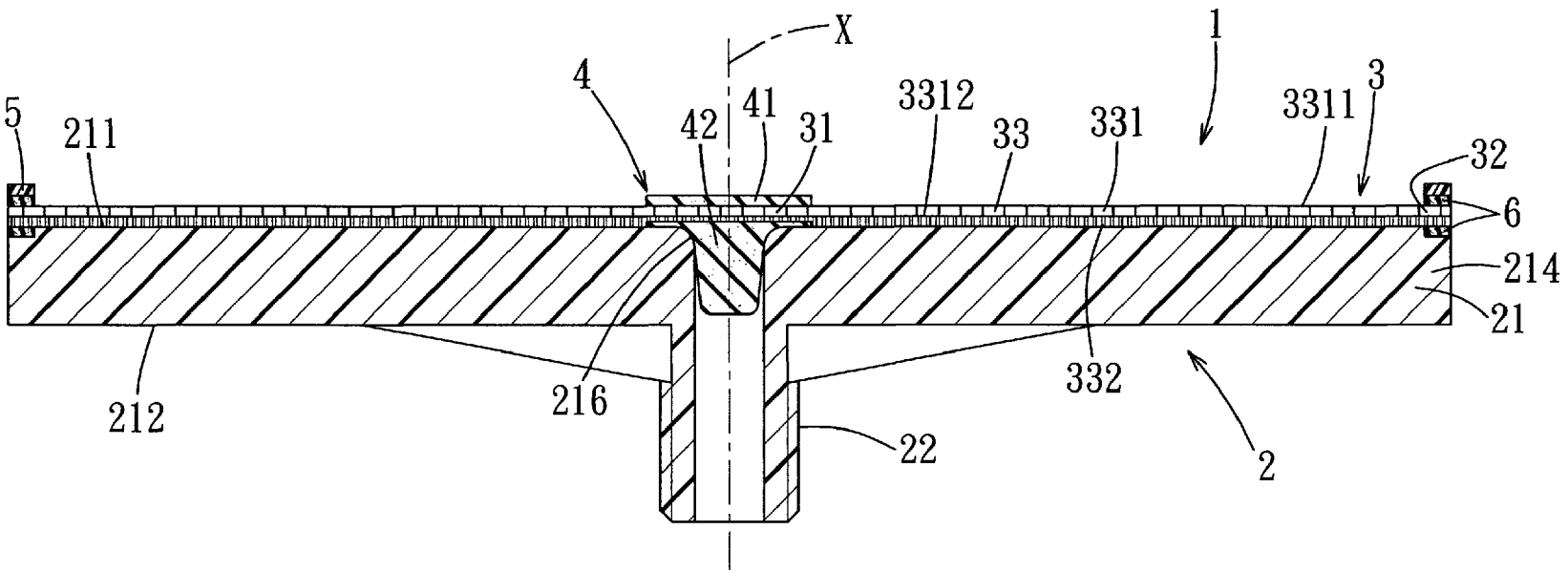
FIG. 3 is a sectional view of the first preferred embodiment at a non-aerating position.

Specifically referring to FIG. 3, when no air is supplied from the conduit 81, the valve member 4 is positioned at the non-aerating position and the valve member 4 is seated on the vale seat 216 to close the inlet 215. The surrounding segment 33, which is at the non-aerating position, stays in abutment with the outer major surface 212.

Figure 4:
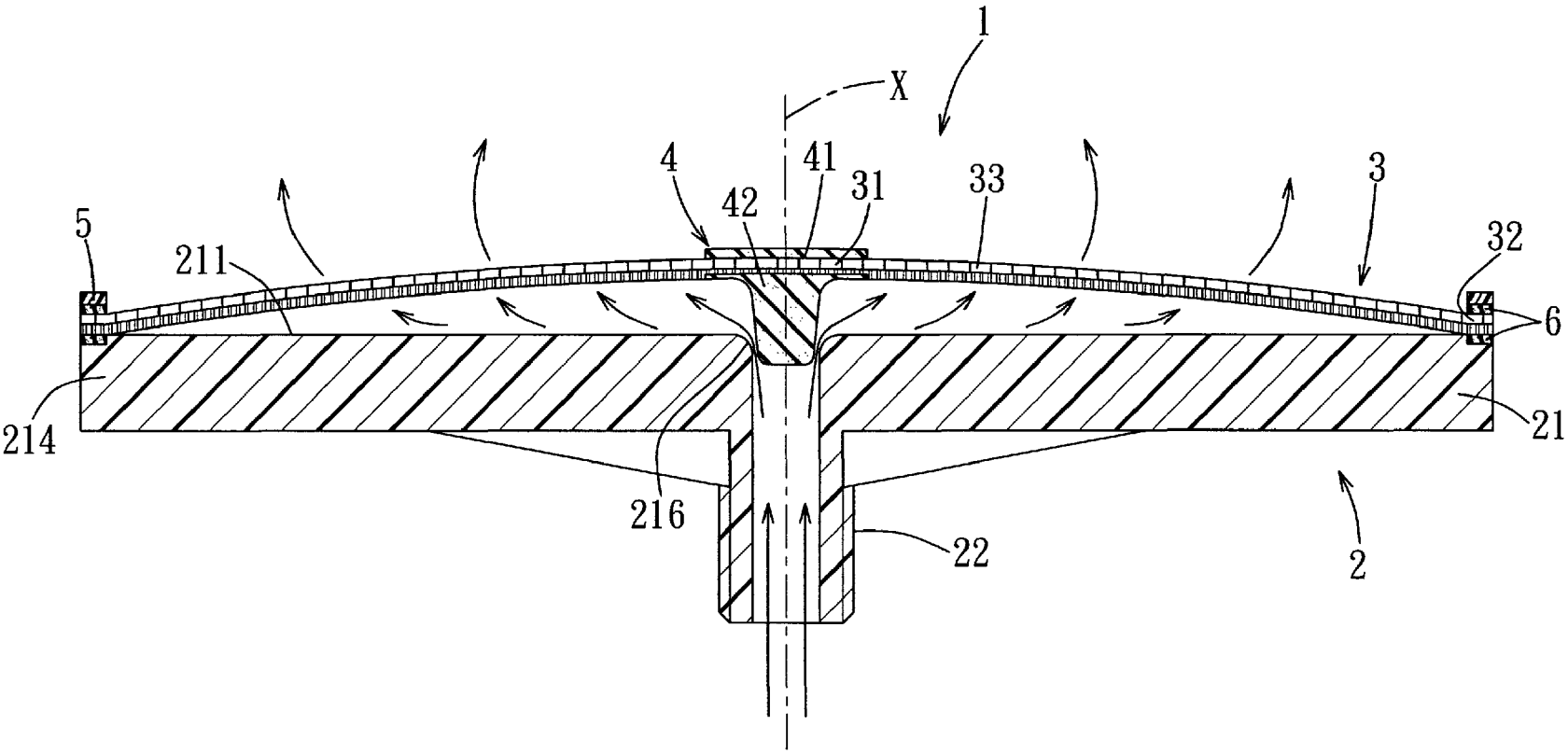
FIG. 4 is a section view of the first preferred embodiment at an aerating position.

Specifically referring to FIG. 4, when air is introduced from the conduit 81, the back pressure in the space defined between the diaphragm 3 and the base 2 will become higher than the ambient pressure at the downstream side, and in turn, forces the valve member 4 to move away from the valve seat 216 and to place the diaphragm 3 at the aerating position, i.e., the valve member 4 and the surrounding segment 33 move away from the valve seat 216 and the outer major surface 211, respectively. The aerating gas then bubbles through the plurality of micropores of the porous foam layer 332. Because of the micropores (i.e., mean size in an order of micrometer) provided in the porous foam layer 332, the radial diffusion of the aerating air from the central portion of the base 2 can be enhanced and the formation of fine bubbles can be increased. As a result, the dissolved oxygen concentration in the pool can increase. Furthermore, since the porous foam layer 332 is formed by applying a foamable synthetic resin composition to the second surface 3312 and subjecting the resin composition to a foaming process, the porous foam layer 332 and the base web layer 331 can be bonded to each other without additional adhesive.

Aeration Experiment

This experiment was carried out using the diffuser 1 of the first embodiment of this invention ("Example"). The base 2 is disk-shaped and has a diameter of about 24.6 cm. The base web layer 331 is made by weaving a plurality of fibrous filaments of about 150 den, and has a basis density of about 180 g/m$^2$ and a thickness of about 0.17 mm. The porous foam layer 332 is made of a polycarbonate resin, and has a mean size of the micropores ranging from 5 μm to 7 μm, a gas permeability ranging from 6 to 9 cc/cm$^2$·sec, and a thickness of about 1 mm. Further, a commercially available diffuser, which is made of EPDM rubber, was employed in the Comparative example. The base of the diffuser of the Comparative Example is disk-shaped and has a diameter of about 24.6 cm. The diffusing membrane of the diffuser of the Comparative Example is made of EPDM rubber, and has a mean pore size of 1000±250 μm and a pore density ranging from 8 to 12 pores/cm$^2$.

The diffuser 1 of the Example and the diffuser of the Comparative example were respectively attached to aeration systems in two test pools. Each of the test pools has a size of 0.35 m (L)×0.35 m (W)×4.66 m (H), and was filled with tap water of 4 m in depth. The two pools were aerated at an air flow rate of 30 L/min by a blower. The oxygen transfer coefficient (αkLa20) and the standard oxygen transfer rate (SOTR) were detected for the Example and the Comparative Example, respectively, and the results of such detection are set forth in Table 1.

TABLE 1

| | Example | Comparative Example |
|---|---|---|
| oxygen transfer coefficient (αkLa20) | 24.4 hr$^{-1}$ | 21.0 hr$^{-1}$ |
| standard oxygen transfer rate (SOTR) | 25.4% | 21.8% |

Table 1 shows that the oxygen transfer coefficient and the standard oxygen transfer rate obtained in the Example are superior to those obtained in the Comparative Example. This indicates that the diffuser 1 of the present invention, when used in an aeration system, can increase the dissolved oxygen concentration in water.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A diffuser for an aeration system, comprising:

a base which has a major wall with a periphery, and which defines a central line that is normal to said major wall, said major wall having an outer major surface and an inner major surface opposite to said outer major surface, and defining an inlet that is adapted to introduce thereinto an aerating gas from the aeration system to generate a back pressure and that extends along the central line through said outer major surface to form thereon a valve seat;

a valve member configured to engage said valve seat so as to close said inlet; and a diaphragm having a central portion disposed to carry said valve member to place said diaphragm at a non-aerating position when said inlet is closed, a peripheral portion which surrounds said central portion, and which is secured to said periphery of said major wall to form upstream and downstream sides separated by said diaphragm such that, when the back pressure at the upstream side is higher than an ambient pressure at the downstream side, said valve member is forced to move away from said valve seat to place said diaphragm at an aerating position, and a surrounding segment interposed between said central portion and said peripheral portion, and including a base web layer having a first surface facing the downstream side and a second surface opposite to said first surface, and including a plurality of fibrous filaments arranged to form a textured structure with a plurality of pores, and a porous foam layer disposed on said second surface of said base web layer, and made of a material which is less flexible than that of said base web layer.

2. The diffuser as claimed in claim 1, wherein said porous foam layer is formed by applying a foamable synthetic resin composition to said second surface, and subjecting said resin composition to a foaming process.

3. The diffuser as claimed in claim 2, wherein said foamable synthetic resin composition comprises a polycarbonate resin.

4. The diffuser as claimed in claim 1, wherein said porous foam layer is configured to stay in abutment with said outer major surface of said major wall at the non-aerating position, and being formed with a plurality of micropores of a dimension such that at the aerating position, the introduced aerating gas is permitted to be bubbled through said micropores of said porous foam layer, and such that said abutment of said porous foam layer with said outer major surface of said major wall is sufficient to institute a barrier to guard against a back flow through each of said micropores immediately after the back pressure drops below the ambient pressure.

5. The diffuser as claimed in claim 4, wherein said pores of said base web layer have such a dimension as not to interfere with the bubbling of the introduced aerating gas through said micropores of said porous foam layer.

6. The diffuser as claimed in claim 5, wherein the mean size of said micropores of said porous foam layer is smaller than that of said pores of said base web layer.

7. The diffuser as claimed in claim 1, wherein said base web layer has an elongation at break of no more than 20%.

8. The diffuser as claimed in claim 1, wherein said porous foam layer has a gas permeability ranging from 1 to 20 cc/cm$^2$·sec.

9. The diffuser as claimed in claim 8, wherein said porous foam layer has a gas permeability ranging from 3 to 10 cc/cm$^2$·sec.

10. The diffuser as claimed in claim 6, wherein the mean size of said micropores of said porous foam layer ranges from 1 μm to 16 μm.

11. The diffuser as claimed in claim 10, wherein the mean size of said micropores of said porous foam layer ranges from 3 μm to 8 μm.

12. The diffuser as claimed in claim 1, wherein said porous foam layer has a thickness ranging from 0.05 mm to 10 mm.

13. The diffuser as claimed in claim 12, wherein said porous foam layer has a thickness ranging from 0.1 mm to 5 mm.

14. The diffuser as claimed in claim 1, wherein base web layer is made of a material selected from the group consisting of a woven fabric, a non-woven fabric, and a mesh structure.

* * * * *